US009358817B2

(12) United States Patent
Obata et al.

(10) Patent No.: US 9,358,817 B2
(45) Date of Patent: Jun. 7, 2016

(54) IMAGE FORMING APPARATUS INCLUDING READING UNIT TO READ BACK SURFACE OF PRINT MEDIUM OPPOSING BELT MEMBER

(71) Applicants: Yuuzoh Obata, Tokyo (JP); Makoto Kikura, Kanagawa (JP); Kazuyoshi Matsumoto, Tokyo (JP); Kazuyoshi Kondo, Tokyo (JP); Gaku Hosono, Kanagawa (JP); Yoshinori Uchino, Kanagawa (JP); Norikazu Yanase, Kanagawa (JP); Daisuke Nakamura, Kanagawa (JP)

(72) Inventors: Yuuzoh Obata, Tokyo (JP); Makoto Kikura, Kanagawa (JP); Kazuyoshi Matsumoto, Tokyo (JP); Kazuyoshi Kondo, Tokyo (JP); Gaku Hosono, Kanagawa (JP); Yoshinori Uchino, Kanagawa (JP); Norikazu Yanase, Kanagawa (JP); Daisuke Nakamura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/027,492

(22) Filed: Sep. 16, 2013

(65) Prior Publication Data

US 2014/0079461 A1 Mar. 20, 2014

(30) Foreign Application Priority Data

Sep. 18, 2012 (JP) ..... 2012-204937
Jun. 17, 2013 (JP) ..... 2013-126825

(51) Int. Cl.

| | |
|---|---|
| ***B41J 11/46*** | (2006.01) |
| ***B41J 15/04*** | (2006.01) |
| ***B41J 13/08*** | (2006.01) |
| ***B41J 11/00*** | (2006.01) |

(52) U.S. Cl.

CPC ..... *B41J 15/048* (2013.01); *B41J 11/007* (2013.01); *B41J 11/0095* (2013.01); *B41J 11/46* (2013.01); *B41J 13/08* (2013.01); *B41J 15/04* (2013.01)

(58) Field of Classification Search

CPC ..... B41J 15/048; B41J 11/46; B65H 29/54; B65H 29/56

See application file for complete search history.

(56) References Cited

U.S. PATENT DOCUMENTS

| | | | | |
|---|---|---|---|---|
| 5,667,213 | A * | 9/1997 | Chida et al. | 270/58.03 |
| 6,016,747 | A * | 1/2000 | Beduhn | B65H 1/22 101/177 |
| 7,496,326 | B2 * | 2/2009 | Kawabata | 399/399 |
| 8,021,063 | B2 * | 9/2011 | Hatano et al. | 400/635 |
| 2002/0140158 | A1 * | 10/2002 | Jaeger | B41J 2/16547 271/125 |
| 2004/0046312 | A1 * | 3/2004 | Thogersen et al. | 271/186 |

(Continued)

FOREIGN PATENT DOCUMENTS

| | | | |
|---|---|---|---|
| CN | 101274546 | A | 10/2008 |
| JP | 04323044 | A * | 11/1992 |

(Continued)

OTHER PUBLICATIONS

IBM Technical Discolsure Bulletin; No. NN80055350; "Nonfired Ceramic Transport System;" May 1980, vol. 22, Issue 12 pp. 5350-5351.*

(Continued)

*Primary Examiner* — Daniel J Colilla
(74) *Attorney, Agent, or Firm* — Cooper & Dunham LLP

(57) ABSTRACT

An image forming apparatus includes an image forming unit and a conveyance unit. The image forming unit forms an image on a print medium. The conveyance unit has a belt member to convey the print medium in a state in which an end of the print medium in a width direction perpendicular to a conveyance direction of the print medium is placed outside an end of the belt member in the width direction.

14 Claims, 11 Drawing Sheets

(56) References Cited

U.S. PATENT DOCUMENTS

| | | | | |
|---|---|---|---|---|
| 2007/0132803 | A1 | 6/2007 | Itoh | 347/19 |
| 2008/0239050 | A1* | 10/2008 | Chikamoto | 347/104 |
| 2010/0141726 | A1 | 6/2010 | Kawakami et al. | |
| 2010/0244364 | A1* | 9/2010 | Komiyama | B65H 29/242 271/12 |
| 2011/0135363 | A1* | 6/2011 | Funayanagi | B65H 29/242 399/397 |
| 2011/0293346 | A1* | 12/2011 | Sato | 400/578 |

FOREIGN PATENT DOCUMENTS

| | | | |
|---|---|---|---|
| JP | 2000-052612 | | 2/2000 |
| JP | 2000-211785 | | 8/2000 |
| JP | 2002-226127 | | 8/2002 |
| JP | 2004-161346 | | 6/2004 |
| JP | 2007-160681 | | 6/2007 |
| JP | 2010-137369 | | 6/2010 |
| JP | 2011213450 | A * | 10/2011 |
| JP | 2012-153073 | | 8/2012 |

OTHER PUBLICATIONS

IBM Technical Discolsure Bulletin; No. NN6906142; "Timing Apparatus for Document Feeding;" Jun. 1969, vol. 12, Issue 1 p. 142.*

U.S. Appl. No. 13/950,473, filed Jul. 25, 2013.

U.S. Appl. No. 13/950,867, filed Jul. 25, 2013.

May 26, 2015 Chinese official action and corresponding Chinese Patent Application No. 201310422640.7.

* cited by examiner

IMAGE FORMING APPARATUS INCLUDING READING UNIT TO READ BACK SURFACE OF PRINT MEDIUM OPPOSING BELT MEMBER

CROSS-REFERENCE TO RELATED APPLICATIONS

This patent application is based on and claims priority pursuant to 35 U.S.C. §119 to Japanese Patent Application Nos. 2012-204937, filed on Sep. 18, 2012, and 2013-126825, filed on Jun. 17, 2013, in the Japan Patent Office, the entire disclosure of each of which is hereby incorporated by reference herein.

BACKGROUND

1 . Technical Field

This disclosure relates o an image forming apparatus.

2 . Description of the Related Art

Image forming apparatuses are used as printers, facsimile machines, copiers, plotters, or multi-functional devices having, e.g., two or more of the foregoing capabilities. For example, there is known an image forming apparatus such as a label printer which prints on a roll print medium (hereinafter also referred to as "label sheet"), such as a tape and a label sheet, and which cuts the medium into desired length after printing to form a print medium piece (hereinafter also referred to as "label piece").

A band-like marking (hereinafter, "I-shaped mark" or also referred to as black mark) to provide an indication of size is added on a surface of the label sheet opposite to a recording surface of the label sheet. The image forming apparatus includes a detector to detect the I-shaped mark to detect a position of the label sheet in a conveyance direction of the label sheet.

For example, there is conventionally known an apparatus including a label roll holder which rotatably holds a label roll, a thermal head which prints predetermined items on a printing surface of a label sheet, a sheet conveyance path through which a label sheet pulled out from the label roll is conveyed, a pair of guide plates which guide the label sheet conveyed through the sheet conveyance path, a sheet sensor which detects presence or absence of label sheets and/or detects a position of a label sheet, and a projection formed in the vicinity of the sheet sensor in one of the pair of guide plates that is opposed to a back surface of the printing surface of the label sheet (JP 2000-052612 A).

For example, when a belt member (belt member) is used for conveying a print medium, a detector (reader) is disposed inside the belt member to read a back surface (surface which comes into contact with the belt member) of the print medium like the roll label sheet. To dispose the detector, a transparent body is used as a belt member, thus increasing costs.

It is also conceivable to detect a marking on a back surface of a label in front of the belt member, and to record and cut the label based on information of the marking. However, such a configuration may result in a reduced precision of a recording position and a cut position. Such a configuration may also hamper precise position detection of a label region which is set on the belt member at the time of initial setting, thus resulting in wasteful abandonment.

BRIEF SUMMARY

In at least one exemplary embodiment of this disclosure, there is provided an image forming apparatus including an image forming unit and a conveyance unit. The image forming unit forms an image on a print medium. The conveyance unit has a belt member to convey the print medium in a state in which an end of the print medium in a width direction perpendicular to a conveyance direction of the print medium is placed outside an end of the belt member in the width direction.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
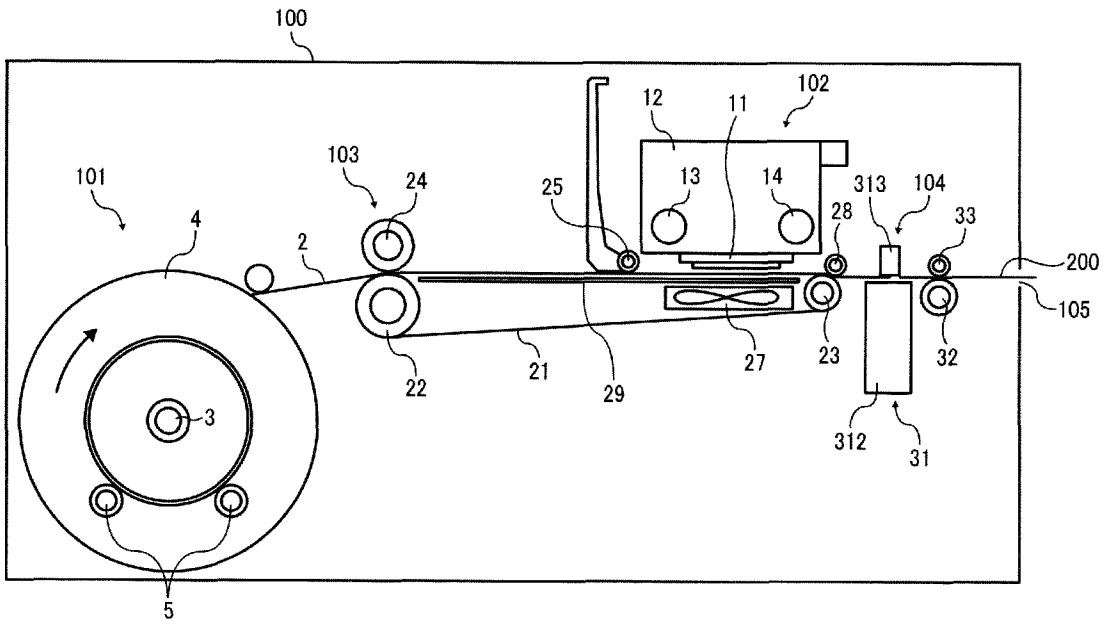
FIG. 1 is a side view of an image forming apparatus according to a first exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

The term "image formation" used herein includes providing not only meaningful images, such as characters and figures, but meaningless images, such as patterns, to print media (in other words, the term "image formation" also includes causing liquid droplets to land on print media).

The term "ink" is not limited to "ink" in a narrow sense, unless specified, but is used as a generic term for any types of liquid usable as targets of image formation. For example, the term "ink" includes recording liquid, fixing solution, liquid, and so on.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to a first exemplary embodiment of this disclosure is described with reference to FIGS. 1 to 3.

FIG. 1 is a side view of an image forming apparatus according to the first exemplary embodiment of this disclosure. FIG. 2 is a plan view of a portion of the image forming apparatus of FIG. 1. FIG. 3 is a cross-sectional front view of a portion of the image forming apparatus cut along a line X1-X1 in FIG. 2 and viewed from a conveyance direction, The image forming apparatus has a sheet feeder 101, an image forming unit 102, and a conveyance unit 103 in an apparatus body 100. The sheet feeder 101 feeds print media 2. The image forming unit 102 serves as an image forming unit to form an image on the print medium 2. The conveyance unit 103 conveys a print medium 2 with the print medium 2 opposing the image forming unit 102. An output conveyance unit 104 is disposed in the apparatus body 100. The output conveyance unit 104 conveys, toward an output port 105, a print medium 2 on which an image is formed and which is sent from the conveyance unit 103.

The sheet feeder 101 is loaded with a roll body 4. The roll body 4 is formed with a print medium 2, such as a liner-less label sheet, wound around a core member 3 in a form of a roll. In some embodiments, the roll body is formed by a print medium 2 wound around in a form of a roll without a core member. The roll body 4 is rotatably supported by roll body-support members 5.

Figure 3:
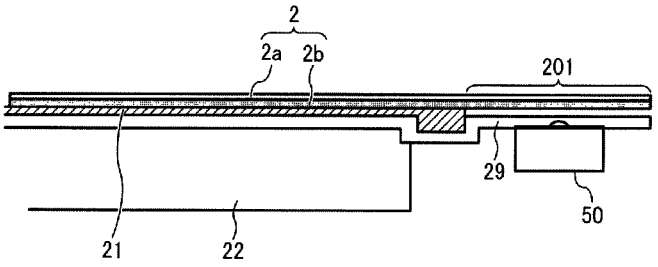
FIG. 3 is a cross-sectional front view of a portion of the image forming apparatus cut along a line X1-X1 in FIG. 2 and viewed from a conveyance direction.

As shown in FIG. 3, the print medium 2 is a continuous body formed by forming an adhesive layer (hereinafter, "adhesive surface") 2*b* on one surface of a medium (hereinafter, "print surface") 2*a* on which an image can be formed. The print medium 2 is wound around the core member 3 in a state in which a pasteboard (release sheet, separator) is not pasted on the adhesive surface 2*b* . I-shaped marks 2*c* which provide indications of positions are provided on a back surface (adhesive surface 2*b*)of the print medium 2 at predetermined intervals. Although the print medium 2 is illustrated as one sheet in drawings described below, the adhesive surface 2*b* is conveyed in a state where the adhesive surface 2*b* is directed to a conveyance member.

The image forming unit 102 includes a carriage 12 having a recording head 11 serving as a liquid ejection head to eject liquid drops to a print medium 2. The carriage 12 is movably held by guide members 13 and 14 and reciprocally moved in a direction (main scanning direction), which is indicated by an arrow MSD in FIG. 2, perpendicular to a conveyance direction of a print medium 2 indicated by an arrow CD in FIG. 2.

The recording head 11 includes, for example, two nozzle rows. In this exemplary embodiment, two recording heads 11 are used to eject ink drops of black (K), cyan (C), magenta (M) and yellow (Y) from four nozzle rows. However, the configuration of the recording head is not limited to the above-described configuration. In some embodiments, a line type head is used.

The image forming unit 102 is not limited to the configuration of the liquid discharge head. Various kinds of image forming units capable of forming an image in a contact or non-contact manner can be used, In the conveyance unit 103, an endless protection belt 21 serving as an adhesive surface protection member is disposed below the recording head 11.

The protection belt 21 is wound around a conveyance roller 22 and a driven roller 23 so as to be movable for circulation. In some embodiments, the protection belt 21 does not have adherence property with respect to the adhesive surface 2*b* . In some embodiments, to prevent a print medium 2 from floating from the protection belt 21 during conveying operation, the protection belt 21 has weak adherence property with respect to the adhesive surface 2*b* so that the protection belt 21 is separable from the adhesive surface 2*b* again.

The protection belt 21 is placed on the adhesive surface 2*b* to protect the adhesive surface 2*b* and prevent the adhesive surface 2*b* from contacting an interior of the apparatus. Thus, conveyance stability is obtained. The protection belt 21 is separable from the adhesive surface 2*b*, thus allowing a print medium 2 to be separately discharged.

A first pressure roller 24 is disposed opposing the conveyance roller 22. The conveyance roller 22 and the first pressure roller 24 sandwich a print medium 2 and the protection belt 21 serving as the adhesive surface protection member together, and convey the print medium 2 and the protection belt 21 to an image forming region by the recording head 11.

Using such a conveyance unit prevents the adhesive surface 2*b* from adhering to a conveyance path through which a print medium 2 is conveyed, thus preventing non conveyable state of the print medium 2. Using such a conveyance unit also prevents an increase in conveyance resistance, thus preventing unstable conveyance behavior.

The protection belt 21 has a large number of holes, and a suction fan 27 disposed inside the protection belt 21 sucks a print medium 2 to adsorb the print medium 2 onto the protection belt 21. In this exemplary embodiment, a print medium 2 is adsorbed onto the protection belt 21 by suction. It is to be noted that the configuration of an absorbing unit to absorb the print medium 2 onto the protection belt 21 is not limited to the above-described configuration. In some embodiments, for example, a print medium 2 is adsorbed by electrostatic force. In some embodiments, adherence property of an adhesive surface 2*b* of a print medium 2 is utilized to fix the print medium 2 on the protection belt 21 so that the print medium 2 does not float from the protection belt 21.

Here, a platen member 29 to support the protection belt 21 is disposed on a back surface side of the protection belt 21.

A second pressure roller 25 is disposed downstream from the conveyance roller 22 and upstream from the image forming region by the recording head 11 in the conveyance direction. The second pressure roller 25 presses a print medium 2 toward the protection belt 21. Such a configuration reliably prevents a print medium 2 from floating from the protection belt 21 in the image forming region.

The output conveyance unit 104A has a cutter unit 31 serving as a cutting unit to cut a print medium 2 into a desired length to form a print medium piece (label piece) 200. The cutter unit 31 includes a receiving member 312 to receive a print medium 2 which is sent out from between the protection belt 21 and a spur 28, and a cutter 313 to cut the print medium 2. The cutter 313 moves in the main scanning direction to cut the print medium 2.

An output roller 32 is disposed downstream from the cutter unit 31 in the conveyance direction. A spur roller 33 is disposed opposing the output roller 32. The output roller 32 and the spur roller 33 hold the label piece 200, which is cut by the cutter unit 31, in a state in which the label piece 200 is sent out to the output port 105.

A surface of the output roller 32 to hold the label piece 200 is, for example, non-adherence processed (processed so that the adhesive surface 2*b* is not adhered to the surface of the output roller 32), thus allowing separation of the adhesive surface 2*b* of the label piece 200. In some embodiments, the output roller 32 itself is made of a material allowing separation of the adhesive surface 2*b* of the label piece 200.

In the image forming apparatus having the above-described configuration, the print medium 2 and the protection belt 21 are sandwiched between the conveyance roller 22 and the first pressure roller 24, and the conveyance roller 22 is rotated and driven. Thus, an adhesive surface of a print medium 2 is conveyed with the adhesive surface protected by the protection belt 21, and a desired image is formed by the recording head 11 of the image forming unit 102.

The protection belt 21 comes off from the print medium 2 on which the image is formed, and only the print medium 2 is sent to the output conveyance unit 104. The print medium 2 is cut at a desired position by the cutter unit 31 and becomes the print medium piece (label piece) 200, and the label piece 200 is held between the output roller 32 and the spur roller 33 in a state in which the print medium piece 200 is drawable from the output port 105 of the apparatus body 100.

Figure 2:
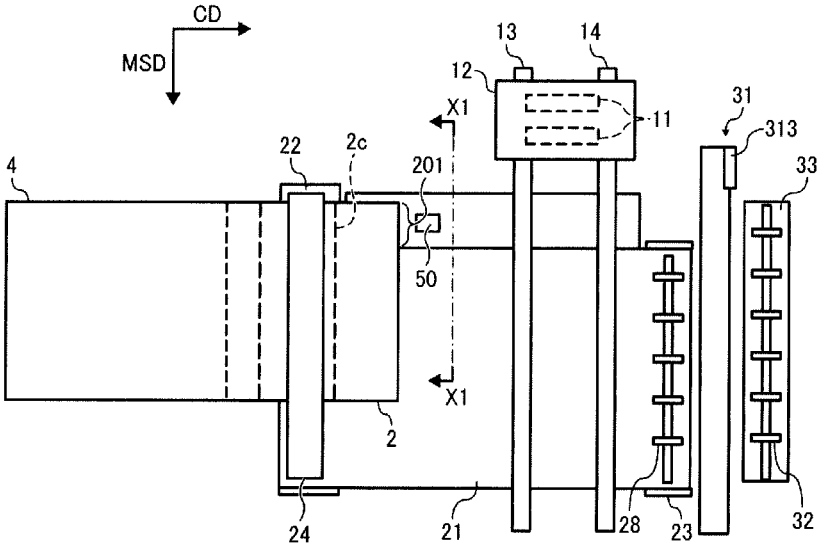
FIG. 2 is a plan view of a portion of the image forming apparatus of FIG. 1.

In the image forming apparatus, as shown in FIGS. 2 and 3, the conveyance unit 103 conveys a print medium 2 in a state in which one end of the print medium 2 in a width direction perpendicular to the conveyance direction CD (also one end in the main scanning direction MSD) is located outward of the end of the protection belt 21 serving as a belt member (belt-shaped member) in the width direction.

That is, when a print medium 2 is fed from the roll body 4 to the protection belt 21, the print medium 2 is shifted in the width direction relative to the protection belt 21, and the print medium 2 is conveyed in such a shifted state.

A reading sensor 50 serving as a reading unit reads the I-shaped marks 2*c* provided on a back surface of a print medium 2 in a non-contact manner. The reading sensor 50 is disposed outside of the protection belt 21 in the width direction corresponding to a portion 201 of the print medium 2 which is shifted outward from the protection belt 21. The reading sensor 50 is, for example, a reflection-type photosensor.

Such a configuration allow the reading sensor 50 to read the I-shaped marks 2*c* provided on a back surface of a print medium 2 (surface which comes into contact with the protection belt 21) while the print medium 2 is adsorbed by the protection belt 21 and conveyed.

Therefore, even if the belt member is used to convey a print medium, the above-described configuration obviate use of transparent body as the belt member and allows the reading sensor 50 to be disposed near the image forming region. Thus, the above-described configuration allows precise reading of a recorded position of a print medium while inexpensively securing conveyance property of the print medium.

Next, a second exemplary embodiment of this disclosure is described with reference to FIGS. 4A and 4B.

Figure 4A:
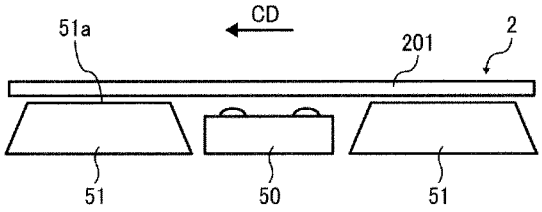
FIGS. 4A and 4B are side views of a reading sensor and a surrounding area thereof in an image forming apparatus according to a second exemplary embodiment of this disclosure.
Figure 4B:
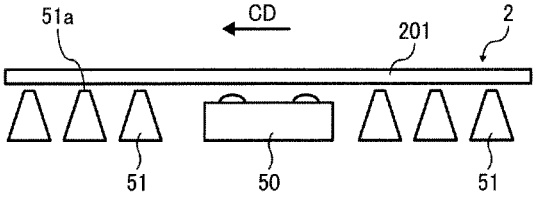

FIGS. 4A and 4B are side views of a reading sensor and a surrounding area thereof in an image forming apparatus according to the second exemplary embodiment of this disclosure.

In this exemplary embodiment, guide members 51 serving as convex conveyance-assisting members, such as ribs and projections, are disposed upstream and downstream from a reading sensor 50 in a conveyance direction of a print medium 2. The guide members 51 can support, at a position above an upper surface of the reading sensor 50, a portion 201 of a print medium 2 which protrudes from a protection belt 21.

Here, FIG. 4A shows an example in which one guide member 51 is disposed each of upstream and downstream from the reading sensor 50 in a conveyance direction of a print medium 2 indicated by an arrow CD in FIG. 4A. FIG. 4B shows an example in which a plurality of the guide members 51 is disposed each of upstream and downstream from the reading sensor 50 in a conveyance direction of a print medium 2 indicated by an arrow CD in FIG. 4B.

When the guide member 51 is formed as a rib, it is preferable that the rib extends along the conveyance direction CD of the print medium 2 because contact resistance generated when an adhesive surface 2*b* comes into contact with the rib becomes small.

In some embodiments, the guide members 51 are integrally formed with the above-described platen member 29.

Providing the guide members 51 to support the portion 201 of the print medium 2 protruding from the protection belt 21 reliably prevents the adhesive surface 2*b* of the print medium 2 from adhering to the reading sensor 50.

Such a configuration also reduces contact areas of the adhesive surface 2*b* of the print medium 2 with the guide member 51, prevents a reduction in conveyance stability of the print medium 2, and suppresses generation of a sheet jam.

To convey a print medium 2 more reliably, in some embodiments, at least an upper surface of the guide member 51 is non-adherence processed (processed so that an adhesive surface of the print medium 2 does not adhere to the upper surface of the guide member 51) relative to the adhesive surface 2*b* to reduce friction with the adhesive surface 2*b* . In some embodiments, the platen member 29 itself is made of material having non-adherence property relative to the adhesive surface 2*b*.

Here, the non-adherence processing does not necessarily mean processing which does not provide adherence property at all but includes processing which provides weak adherence property. More specifically, adherence property with respect to an adhesive surface 2*b* of a print medium 2 is lower than that of a surface of the protection belt 21 which is conveyed together with and separable from the print medium 2. This is because that the surface of the protection belt 21 does not preferably slip over the adhesive surface 2*b* but the guide member 51 preferably slips over the adhesive surface 2*b* when the guide member 51 contacts the adhesive surface 2*b*.

Next, a third exemplary embodiment of this disclosure is described with reference to FIG. 5.

Figure 5:
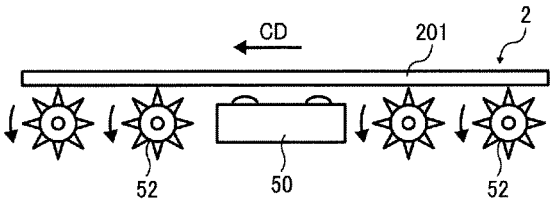
FIG. 5 is a side view of a reading sensor and a surrounding area thereof in an image forming apparatus according to a third exemplary embodiment of this disclosure.

FIG. 5 is a side view of a reading sensor and a surrounding area thereof in an image forming apparatus according to the third exemplary embodiment of this disclosure.

In this exemplary embodiment, one or more spurs 52 serving as conveyance-assisting members to support a portion 201 of a print medium 2 protruding from a protection belt 21 are disposed upstream and downstream from a reading sensor 50 in a conveyance direction indicated by an arrow CD in FIG. 5. The spurs 52 rotate with movement of the print medium 2. Here, a circumferential surface of each spur 52 is a support surface.

The spurs 52 support the portion 201 of the print medium 2 which protrudes from the protection belt 21, and rotate following movement of the print medium 2. Such a configuration further reduces contact areas of an adhesive surface 2*b* of the print medium 2 and the spurs 52 as compared with the above-described guide members 51, reduces conveyance resistance, and allows more stable conveyance of the print medium 2.

To convey the print medium more reliably, as in the second exemplary embodiment, the circumferential surface of the spur 52 may be non-adherence processed (processed so that an adhesive surface 2*b* of a print medium 2 does not adhere to the circumferential surface of the spur 52) with respect to the adhesive surface 2*b*.

Next, a fourth exemplary embodiment of this disclosure is described with reference to FIGS. 6 and 7.

Figure 6:
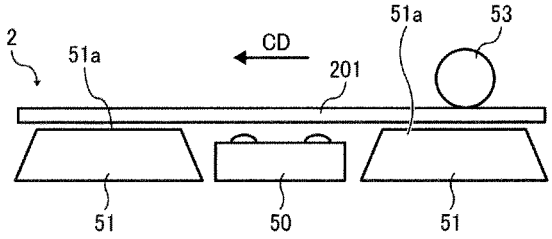
FIG. 6 is a side view of a reading sensor and a surrounding area thereof in an image forming apparatus according to a fourth exemplary embodiment of this disclosure.

FIG. 6 is a side view of a reading sensor and a surrounding area thereof in an image forming apparatus according to the fourth exemplary embodiment of this disclosure. FIG. 7 is a cross-sectional front view of a portion of the image forming apparatus according to the fourth exemplary embodiment, cut and viewed in the same way as in FIG. 3.

The fourth exemplary embodiment differs from the configuration of the second exemplary embodiment in that rotary bodies 53, such as rollers, to press a print medium 2 to prevent floating of the print medium 2 are disposed opposing an upstream guide member 51. In some embodiments, the rotary bodies 53 are disposed opposing spurs 52 as described in the third exemplary embodiment.

Here, as shown in FIG. 6, the rotary body 53 prevents the print medium 2 from floating, and the rotary body 53 does not press the guide member 51. Therefore, such a configuration gives little change to friction between an adhesive surface 2*b* and the guide member 51, and does not affect the conveyance performance.

Figure 7:
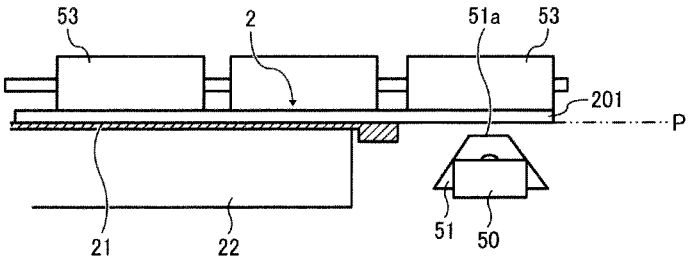
FIG. 7 is a cross-sectional front view of a portion of the image forming apparatus according to the fourth exemplary embodiment, cut and viewed in the same way as in FIG. 3.

As shown in FIG. 7, the guide member 51 which is a conveyance-assisting member is disposed such that a support surface 51*a* of the guide member 51 is located lower than a position of a surface (conveyance surface) of a protection belt 21 indicated by a broken line P in FIG. 7.

As described above, the print medium 2 is pressed from above at a location upstream from an image forming region outside the protection belt 21 in a width direction in this manner, thus preventing the print medium 2 from floating from the surface of the protection belt 21. Such a configuration reliably prevents detection failure which is caused by variation of a distance between a reading sensor 50 and the print medium 2, occurrence of a jam caused by interference between the print medium 2 and a recording head 11 in the image forming region, and deterioration in image quality caused by image disturbance.

Next, a fifth exemplary embodiment of this disclosure is described with reference to FIG. 8.

Figure 8:
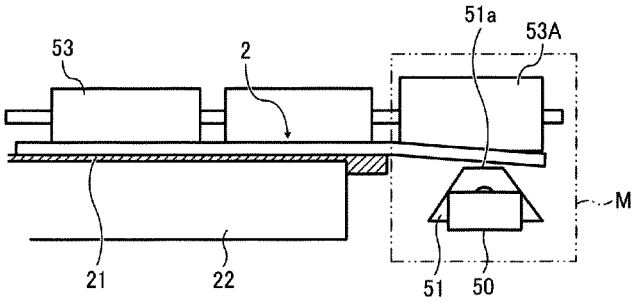
FIG. 8 is a cross-sectional front view of a portion of an image forming apparatus according to a fifth exemplary embodiment, cut and viewed in the same way as in FIG. 3.

FIG. 8 is a cross-sectional front view of a portion of an image forming apparatus according to the fifth exemplary embodiment, cut and viewed in the same way as in FIG. 3.

The fifth exemplary embodiment differs from the fourth exemplary embodiment in that a rotary body 53A serving as a press member to press a portion of a print medium 2 protruding from a protection belt 21 has a diameter greater than that of any other rotary body 53, and a circumferential surface of the rotary body 53A is located lower than the protection belt 21.

Such a configuration gives the same operation effects as those of the fourth exemplary embodiment, and allows a portion 201 of the print medium 2 protruding from the protection belt 21 to be pressed against a support surface 51*a* of a guide member 51. Thus, variation of a distance between a reading sensor 50 and the print medium 2 can be more reliably reduced.

In this case, a region in which the rotary body 53A presses the print medium 2 is made as a margin region M in a width direction, thus suppressing a printing image deviation which may be caused by applying stiffness to the recording medium 2.

Figure 9:
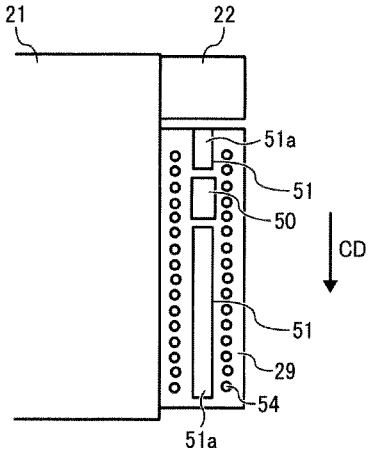
FIG. 9 is a plan view of a portion of an image forming apparatus according to a sixth exemplary embodiment of this disclosure.

Next, a sixth exemplary embodiment of this disclosure is described with reference to FIG. 9. FIG. 9 is a plan view of a portion of an image forming apparatus according to the sixth exemplary embodiment of this disclosure.

In the sixth exemplary embodiment, suction holes 54 through which air is sucked are formed in a platen member 29 at positions corresponding to portions 201 of a print medium 2 protruding from a protection belt 21. The suction holes 54 are formed on both sides of a guide member 51 in a width direction thereof along a conveyance region of the protection belt 21.

Such a configuration allows a suction fan 27 to suck the portions 201 protruding from the protection belt 21 toward a support surface 51*a* of the guide member 51.

In FIG. 9, the guide member 51 is continuously formed. However, in some embodiments, the guide member 51 is divided into a plurality of members in a conveyance direction as described above. The sixth exemplary embodiment is also applicable to a configuration in which the spurs 52 are disposed instead of the guide member 51 as described above.

Such a configuration gives the same operation effects as those of the fourth exemplary embodiment. The portions 201 of the print medium 2 protruding from the protection belt 21 are pressed against the support surface 51*a* of the guide member 51, thus more reliably reducing a variation of a distance between a reading sensor 50 and the print medium 2.

Next, a seventh exemplary embodiment of this disclosure is described with reference to FIG. 10.

Figure 10:
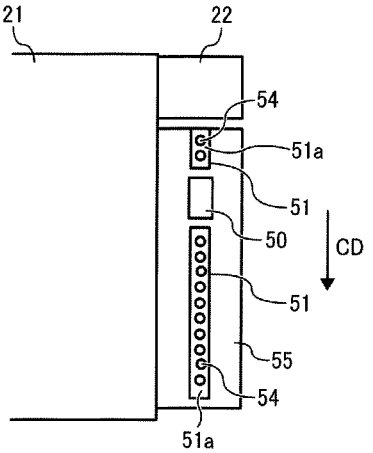
FIG. 10 is a plan view of a portion of an image forming apparatus according to a seventh exemplary embodiment of this disclosure.

FIG. 10 is a plan view of a portion of an image forming apparatus according to the seventh exemplary embodiment of this disclosure.

In the seventh exemplary embodiment, a dimple-shaped member 55, which may be a portion of a platen member 29 in some embodiments, including air-suction holes 54 is disposed on guide members 51 which guide a portion of a print medium 2 protruding from a protection belt 21, or between the guide members 51.

An air suction region is formed in a dimple shape and a partially closed region is provided, thus increasing a force for sucking the print medium 2 and more effectively preventing the print medium 2 from floating up.

This exemplary embodiment is also applicable to a configuration in which the spurs 52 are disposed as described above instead of the guide member 51.

Next, an eighth exemplary embodiment of this disclosure is described with reference to FIG. 11.

Figure 11:
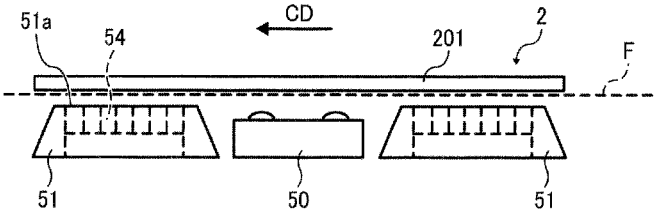
FIG. 11 is a side view of a reading sensor and a surrounding area thereof in an image forming apparatus according to an eighth exemplary embodiment of this disclosure.

FIG. 11 is a side view of a reading sensor and a surrounding area thereof in an image forming apparatus according to the eighth exemplary embodiment of this disclosure.

For the eighth exemplary embodiment, in addition to the configuration of the seventh exemplary embodiment, an upper surface of a dimple-shaped air suction region is disposed lower than a conveyance surface of a protection belt 21.

Such a configuration prevents a print medium 2 from contacting a dimple-shaped member and reducing conveyance resistance caused by suction of air.

Next, a ninth exemplary embodiment of this disclosure is described with reference to FIG. 12.

Figure 12:
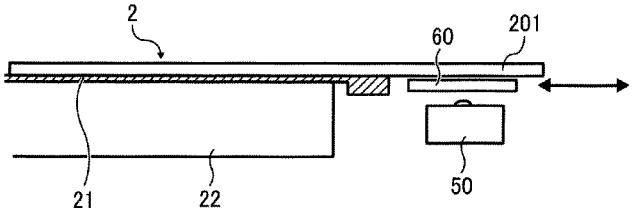
FIG. 12 is a cross-sectional front view of a portion of an image forming apparatus according to a ninth exemplary embodiment of this disclosure, cut and viewed in the same way as in FIG. 3.

FIG. 12 is a cross-sectional front view of a portion of an image forming apparatus according to the ninth exemplary embodiment of this disclosure, cut and viewed in the same way as in FIG. 3.

For the ninth exemplary embodiment, a cover 60 made of, for example, a transparent sheet-shaped Mylar, is provided to cover an upper surface of a reading sensor 50. The cover 60 is replaceable with new one by inserting the cover 60 into the above-described platen member 29 or pulling the cover 60 out from the platen member 29.

Covering the upper surface of the reading sensor 50 with the cover 60 prevents ink mist, which is generated in printing operation or maintenance operation of a recording head, or scattered foreign matters, such as paper dust, which is generated when a print medium 2 is conveyed, from remaining on a surface of the reading sensor 50, thus preventing detection failure. Further, the cover 60 is replaceably provided, thus facilitating replacement of components.

Next, a tenth exemplary embodiment of this disclosure is described with reference to FIG. 13.

Figure 13:
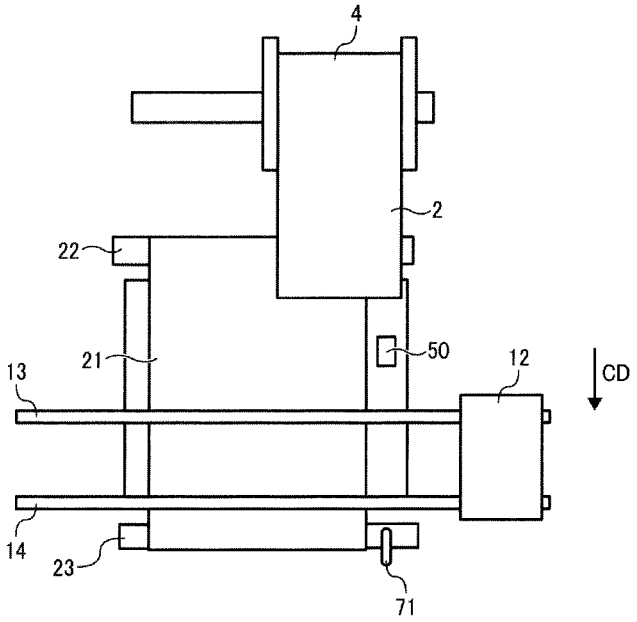
FIG. 13 is a plan view of a portion of an image forming apparatus according to a tenth exemplary embodiment of this disclosure.

FIG. 13 is a plan view of a portion of an image forming apparatus according to the tenth exemplary embodiment of this disclosure.

For the tenth exemplary embodiment, the image forming apparatus includes a separating guide member 71 to guide a portion of a print medium 2 located outside of an end of a protection belt 21 in a width direction thereof (portion of the print medium 2 protruding from the protection belt 21) by a driven roller 23 serving as a separation part to separate the print medium 2 from the protection belt 21.

Figure 14:
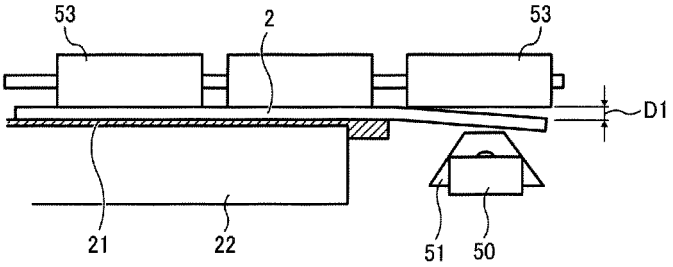
FIG. 14 is a front view of a hanging state of a portion of a print medium protruding from a protection belt in a comparative example.

For example, as shown in FIG. 14, when the print medium 2 is read by a reading sensor 50 outside the protection belt 21, a portion of the print medium 2 protruding from the protection belt 21 might hang down by its own weight or by the suction of air.

As a result, if the print medium 2 which is separated from the protection belt 21 is directly sent out to a downstream side in a conveyance direction, the print medium 2 might interfere with other members, thus resulting in conveyance failure.

Hence, in the tenth exemplary embodiment, when the print medium 2 is separated from the protection belt 21, the separating guide member 71 scoops up the portion of the print medium 2 protruding from the protection belt 21 and sends out the print medium 2 to the downstream side.

Such a configuration allows the print medium to be stably sent out to the downstream side without causing conveyance failure.

For the image forming apparatus, a print medium 2 which is sent out from the protection belt 21 is sent to a cutter unit 31. After the print medium 2 is cut, the print medium 2 is sent out to an output port 105. However, in some embodiments, when the image forming apparatus does not include the cutter unit (cutting unit) or the cutter unit is provided downstream of the output port 105, the print medium 2 which is sent out from the protection belt 21 is sent out directly to the output port 105.

Even in such a case in which the print medium is sent out directly to the discharge port, the separating guide member 71 scoops up the portion of the print medium protruding from the protection belt 21 and sends the print medium toward the output port 105, thus preventing interference of the print medium 2 with, e.g., the output port 105 and conveyance failure and allowing the print medium to be stable sent out.

Next, an eleventh exemplary embodiment of this disclosure is described with reference to FIGS. 15 and 16.

Figure 15:
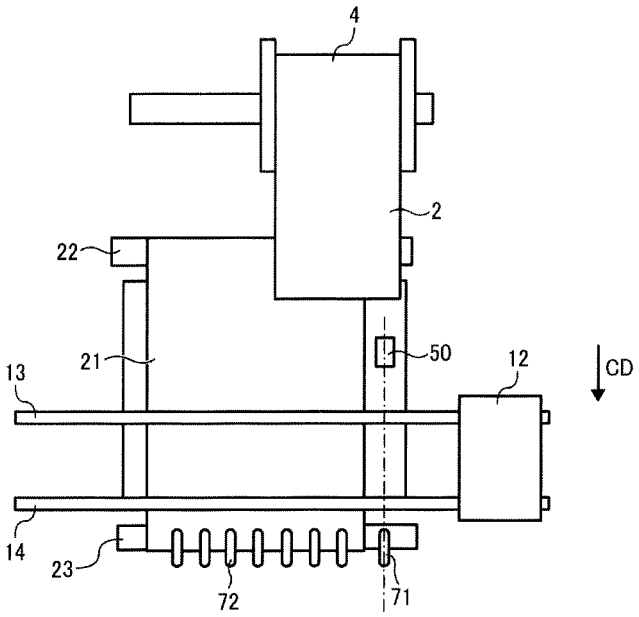
FIG. 15 is a plan view of a portion of an image forming apparatus according to an eleventh exemplary embodiment of this disclosure.
Figure 16:
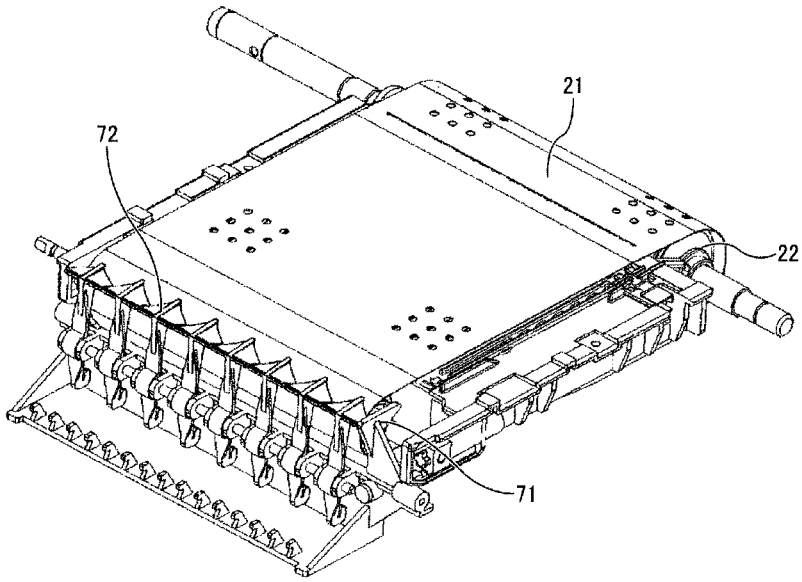
FIG. 16 is a perspective view of a portion of he image forming apparatus according to the eleventh exemplary embodiment.

FIG. 15 is a plan view of a portion of an image forming apparatus according to the eleventh exemplary embodiment of this disclosure. FIG. 16 is a perspective view of a portion of the image forming apparatus according to the eleventh exemplary embodiment.

In the eleventh exemplary embodiment, a separating guide member 71 as described in the tenth exemplary embodiment is disposed at the same position as a reading sensor 50 or closer to a protection belt 21 (closer to the belt member) than the same position in a direction perpendicular to a conveyance direction CD of a print medium 2. That is, in the conveyance direction CD of the print medium, the separating guide member 71 is disposed at a position at which the separating guide member 71 is arrayed in tandem with the reading sensor 50, or is disposed at a position closer to the protection belt 21 than the position at which the separating guide member 71 is arrayed in tandem with the reading sensor 50.

That is, a protruding amount of the print medium 2 from the protection belt 21 is set in accordance with the position of the reading sensor 50. Therefore, to reliably support an end of the print medium 2 and to separate the print medium 2, it is preferable to match the position of the separating guide member 71 with the position of the reading sensor 50.

In the eleventh exemplary embodiment, separation pawls 72 which are separation pawl members for separating the print medium 2 from the protection belt 21 are disposed downstream of the protection belt 21 in a conveyance direction CD of the print medium 2. The plurality of separation pawls 72 is arranged in a width direction of the protection belt 21 so as to be able to separate a print medium 2 having a desired width.

In such a case, it is preferable that the distance between the separating guide member 71 and one of the separation pawls 72 that is disposed closest to the separating guide member 71 is not so great. For example, in some embodiments, the distance is equal to or smaller than a distance between adjacent separation pawls 72.

If the distance between the separation pawl 72 and the separating guide member 71 is greater than the distance between the adjacent separation pawls 72, the following case might occur. That is, when a portion of a print medium 2 on the protection belt 21 has come off, a portion of the print medium 2 at an intermediate position between the separation pawl 72 and the separating guide member 71 (more specifically, a portion of the print medium 2 corresponding to a lateral side end of the protection belt 21) has not come off. As a result, the print medium 2 might be wound around the protection belt 21 at the end of the protection belt 21, thus causing a sheet jam.

From this point, it is also preferable that, in the conveyance direction of the print medium, the separating guide member 71 is disposed at a position at which the separating guide member 71 is arrayed in tandem with the reading sensor 50, or the separating guide member 71 is disposed closer to the protection belt 21 than the position at which the separating guide member 71 is arrayed in tandem with the reading sensor 50.

Next, a twelfth exemplary embodiment of this disclosure is described with reference to FIG. 17.

Figure 17:
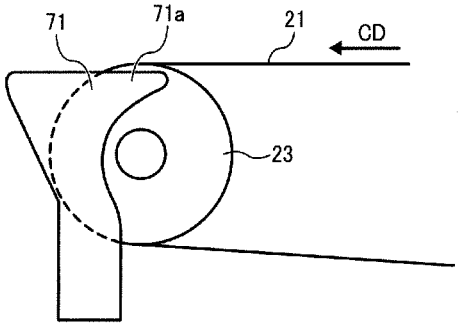
FIG. 17 is a side view of a portion of an image forming apparatus according to a twelfth exemplary embodiment of this disclosure.

FIG. 17 is a side view of a portion of an image forming apparatus according to the twelfth exemplary embodiment of this disclosure.

In the twelfth exemplary embodiment, a separating guide member 71 is disposed in a state in which, when viewed from an axial direction of the driven roller 23, a tip end 71*a* of the separating guide member 71 at an upstream side in a conveyance direction of a print medium is placed at an inner position in a radial direction of a driven roller 23 than an outer circumferential surface of the driven roller 23. The driven roller 23 serves as a separation roller around which a protection belt 21 is wound.

Figure 18:
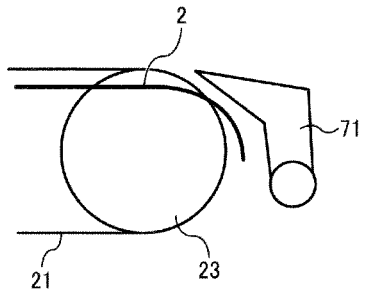
FIG. 18 is a side view of a portion of an image forming apparatus according to a comparative example.

That is, a portion of the print medium 2 guided by the separating guide member 71 protrudes from the protection belt 21. As shown in FIG. 14, the print medium 2 is conveyed in a state in which the protruding portion hangs to a position lower than a conveyance surface of the protection belt 21. As a result, if the tip end 71*a* of the separating guide member 71 is located on an outer side than a circumferential surface of the driven roller 23 as in a comparative example shown m FIG. 18, the print medium 2 may be wound around to a lower side of the separating guide member 71.

Hence, by employing the configuration of the twelfth exemplary embodiment, the separating guide member 71 reliably scoops up a portion of the print medium 2 protruding from the protection belt 21, thus allowing stable conveyance of the print medium 2.

Next, a thirteenth exemplary embodiment of this disclosure is described with reference to FIG. 19.

Figure 19:
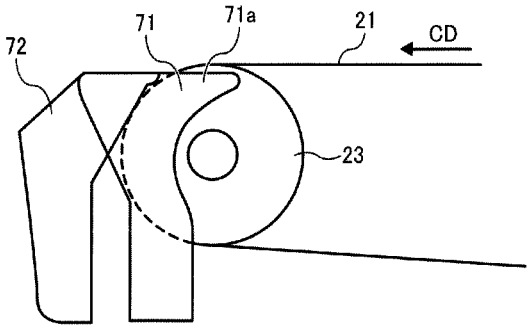
FIG. 19 is a side view of a portion of an image forming apparatus according to a thirteenth exemplary embodiment of this disclosure.

FIG. 19 is a side view of a portion of an image forming apparatus according to the thirteenth exemplary embodiment of this disclosure.

In the thirteenth exemplary embodiment, a separating guide member 71 and a separation pawl 72 are disposed at positions at which uppermost surfaces (guide surfaces) of the separating guide member 71 and the separation pawl 72 to guide a separated print medium have the same height.

That is, if the guiding surfaces do not have the same heights inside and outside a protection belt 21, a print medium would be conveyed in a convex form (bowl form) on a downstream side of the protection belt 21 as viewed from a conveyance direction. As a result, a lateral side end of the print medium might be caught by, e.g., a cutter unit 31, thus causing a jam. Hence, the separation pawl 72 and the separating guide member 71 outside the protection belt 21 are preferably disposed at positions at which the uppermost surfaces of the separation pawl 72 and the separating guide member 71 to guide a separated print medium have the same height.

Here, as shown in FIG. 17, the separating guide member 71 is preferably disposed such that a tip end 71*a* of the separating guide member 71 at the upstream side in the conveyance direction of the print medium is placed at an inner side in a radial direction of a driven roller 23 than an outer circumferential surface of the driven roller 23 as viewed from an axial direction of the driven roller 23. The driven roller 23 is a separating roller around which the protection belt 21 is wound. However, since the separation pawl 72 interferes with the protection belt 21, the separation pawl 72 can not be disposed at the same position as the separating guide member 71 as viewed from the axial direction of the driven roller 23. Hence, as shown in FIG. 19, the separation pawl 72 is disposed such that a tip end thereof is shifted toward a downstream side in the conveyance direction of the print medium from a tip end of the separating guide member 71 and such that the uppermost surfaces of the separation pawl 72 and the separating guide member 71 are placed at the same height.

Next, a fourteenth exemplary embodiment of this disclosure is described with reference to FIG. 20.

Figure 20:
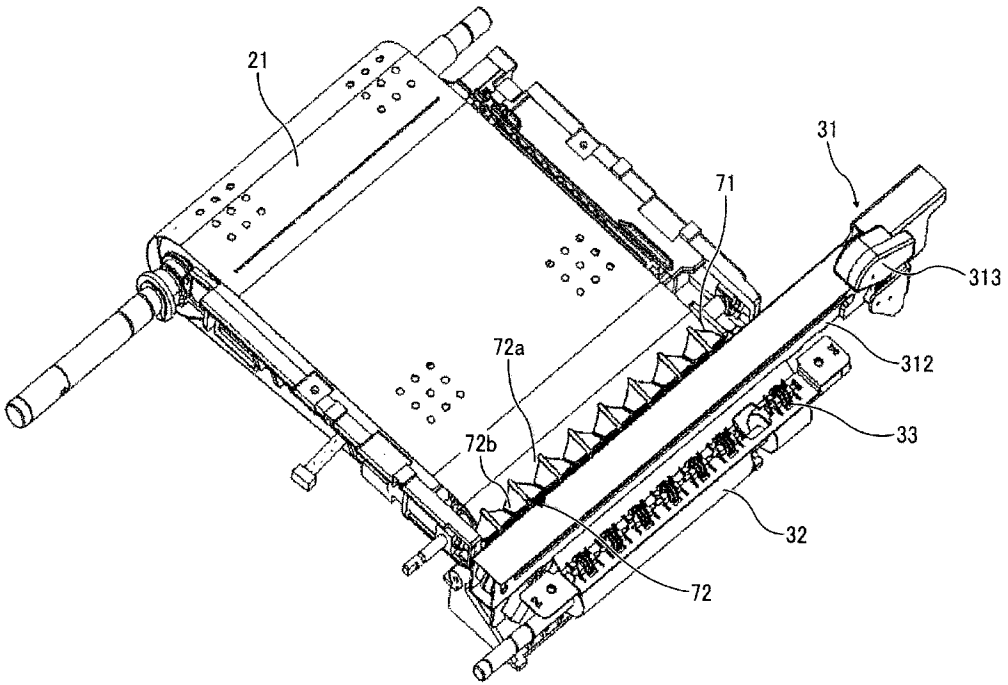
FIG. 20 is a perspective view of a portion of an image forming apparatus according to a fourteenth exemplary embodiment of this disclosure.

FIG. 20 is a perspective view of a portion of an image forming apparatus according to the fourteenth exemplary embodiment of this disclosure.

In the fourteenth exemplary embodiment, a separation pawl 72 disposed in a region opposing a protection belt 21 includes a tip end 72*a* which comes into contact with the protection belt 21, and a leading-end hanging guide member 72*b* to receive a hanging portion of a leading end of a print medium 2 in a conveyance direction of the print medium 2.

If the print medium 2 is a weak sheet of paper or a sheet of paper which is weakened due to a usage environment condition and the sheet of paper is to be separated using a separation pawl (see separation pawl illustrated in FIG. 15) having the tip end 72*a* extended in the conveyance direction of a print medium, a leading end of the print medium 2 downwardly hangs down at a location (between the separation pawls 72) other than the tip end 72*a*, the print medium would be conveyed to a cutter unit 31 in a state in which an attitude of the leading end of the print medium is unstable, thus causing a jam.

Hence, the leading-end hanging guide member 72*b* is provided to receive the hanging portion of the leading end of the print medium between the separation pawls 72 and the print medium is guided so as to be brought up to a location near the uppermost surface of the separation pawl. As a result, a position of the leading end of the print medium 2 is stabilized, thus allowing the print medium 2 to be smoothly be conveyed to the cutter unit 31.

In each of the above-described exemplary embodiments, the print medium has an adhesive layer and the print medium is made by forming, into a roll body, a liner-less label sheet having no release sheet which protects the adhesive layer. However, the type of print media is not limited to the above-described configuration. For example, the claimed invention is also applicable to an image forming apparatus that uses other type of print medium such as a roll sheet and a label sheet in which a release sheet is pasted on an adhesive layer.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image forming unit to form an image on a print medium;

a conveyance unit having a belt member to convey the print medium in a conveyance direction in a state in which an edge of the print medium in a width direction perpendicular to the conveyance direction of the print medium is placed outside an edge of the belt member in the width direction; and a reading unit to read a back surface of the print medium opposing the belt member, at a position outside the belt member;

wherein the reading unit is disposed upstream, in the conveyance direction, of the image forming unit and, before the image is formed on the print medium, reads one or more markings, indicating respective positions along the conveyance direction of the print medium, on the back surface of the print medium.

2. The image forming apparatus of claim 1, further comprising a separation guide member to guide a portion of the print medium placed outside the edge of the belt member in the width direction, at a position at which the print medium separates from the belt member, wherein the separation guide member is disposed (a) on a same line drawn perpendicularly to the width direction perpendicular to the conveyance direction of the print medium position as the reading unit or (b) at a position between the belt member and the edge of the print medium in the width direction perpendicular to the conveyance direction of the print medium.

3. The image forming apparatus of claim 2, further comprising rotary bodies around which the belt member is wound, wherein the separation guide member is disposed in a state in which, when viewed from an axial direction of one of the rotary bodies, a tip end of the separation guide member at an upstream side in the conveyance direction of the print medium is placed at an inner position in a radial direction of the one of the rotary bodies inside an outer circumferential surface of the one of the rotary bodies.

4. The image forming apparatus of claim 2, further comprising a separation pawl member to separate the print medium from the belt member, wherein the separation pawl member and the separation guide member have topmost surfaces to guide the print medium separated and are arranged at positions at which the topmost surfaces are placed at a same height.

5. The image forming apparatus of claim 1, wherein the print medium is a roll sheet.

6. The image forming apparatus of claim 1, wherein the print medium has an adhesive surface with no release sheet on the adhesive surface.

7. The image forming apparatus of claim 6, further comprising a conveyance assisting member having a support surface to support the print medium at a position outside the belt member, wherein the support surface has no adherence to the adhesive surface of the print medium.

8. The image forming apparatus of claim 6, further comprising a conveyance assisting member having a support surface to support the print medium at a position outside the belt member, wherein the support surface is made of a material having a smaller adherence to the adhesive surface of the print medium than a surface of the belt member.

9. The image forming apparatus of claim 1, wherein the print medium has an adhesive surface and a release sheet on the adhesive surface.

10. The image forming apparatus of claim 1, further comprising a conveyance assisting member having a support surface to support the print medium at a position outside the belt member, wherein the support surface is disposed at a position lower than a surface of the belt member.

11. The image forming apparatus of claim 10, further comprising an attachment unit to attach the print medium onto the support surface of the conveyance assisting member.

12. The image forming apparatus of claim 1, further comprising a separation guide member to guide a portion of the print medium placed outside the edge of the belt member in the width direction, at a position at which the print medium separates from the belt member.

13. The image forming apparatus of claim 12, further comprising rotary bodies around which the belt member is wound, wherein the separation guide member is disposed in a state in which, when viewed from an axial direction of one of the rotary bodies, a tip end of the separation guide member at an upstream side in the conveyance direction of the print medium is placed at an inner position in a radial direction of the one of the rotary bodies inside an outer circumferential surface of the one of the rotary bodies.

14. The image forming apparatus of claim 12, further comprising a separation pawl member to separate the print medium from the belt member, wherein the separation pawl member and the separation guide member have topmost surfaces to guide the print medium separated and are arranged at positions at which the topmost surfaces are placed at same height.

* * * * *